United States Patent [19]

Barradas

[11] Patent Number: 4,572,221

[45] Date of Patent: Feb. 25, 1986

[54] SOFT ROLLER HAIR CURLER AND HEATING ARRANGEMENT THEREFOR

[76] Inventor: George Barradas, 15 Riverview Ct., Glenville, Conn. 06830

[21] Appl. No.: 619,639

[22] Filed: Jun. 11, 1984

[51] Int. Cl.[4] ..... A45D 2/12

[52] U.S. Cl. ..... 132/33 R; 132/55

[58] Field of Search ..... 132/33 R, 40, 42, 9, 132/55

[56] References Cited

U.S. PATENT DOCUMENTS

| | | | |
|---|---|---|---|
| 894,762 | 7/1908 | Taylor | 132/55 |
| 2,074,816 | 3/1937 | Trotter | 132/33 R |
| 3,382,876 | 5/1968 | Spier | 132/33 R |
| 3,560,703 | 2/1971 | Chedister | 132/33 R |
| 3,600,552 | 8/1971 | Tolmie . | |
| 4,236,540 | 12/1980 | Takagi | 132/33 R |

*Primary Examiner*—Gregory E. McNeill

*Attorney, Agent, or Firm*—Alfred E. Miller

[57] ABSTRACT

A soft roller hair curler having an outer sleeve of silicone rubber and an inner core of an elongated heatable material, such as a coil spring. One end of the roller is provided with a flexible loop or cap which fits over the other end of the roller when the ends are bent to a position adjacent to each other. A carrying case with heating posts for a plurality of rollers is provided.

7 Claims, 11 Drawing Figures

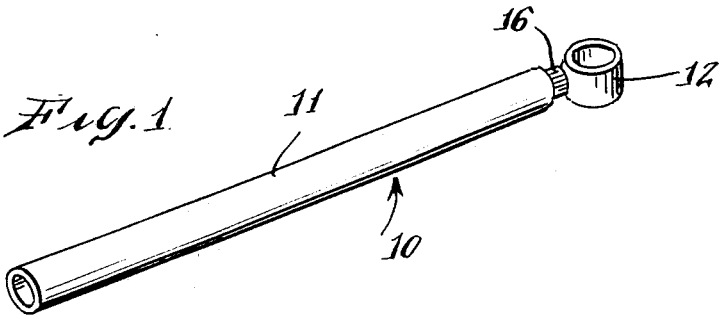
Fig. 1
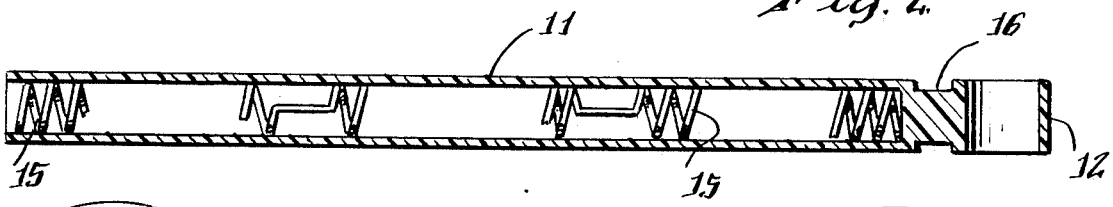
Fig. 2
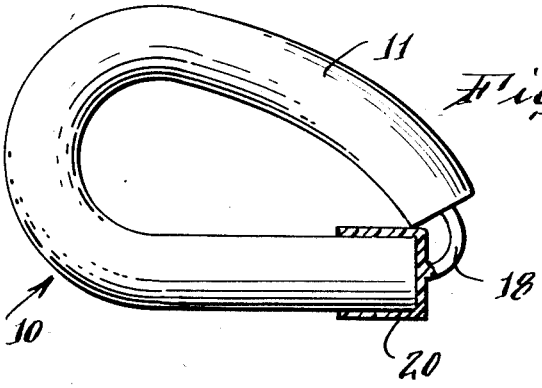
Fig. 5
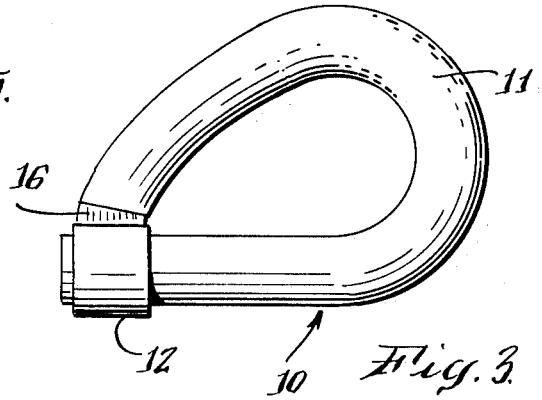
Fig. 3
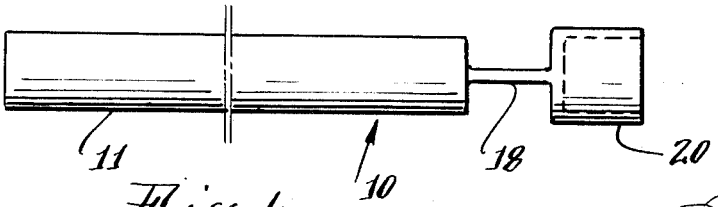
Fig. 4
Fig. 7
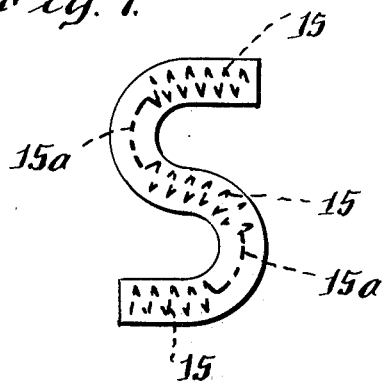
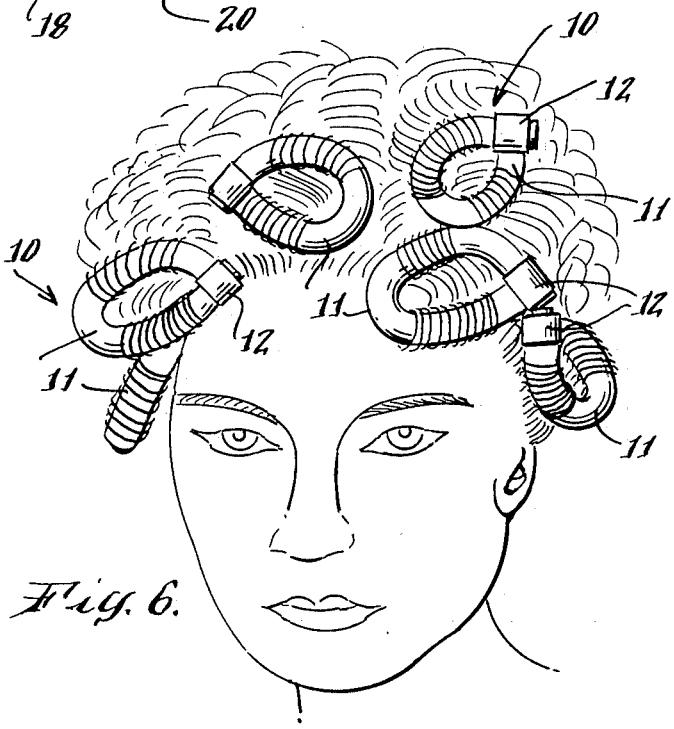
Fig. 6

Fig. 8.
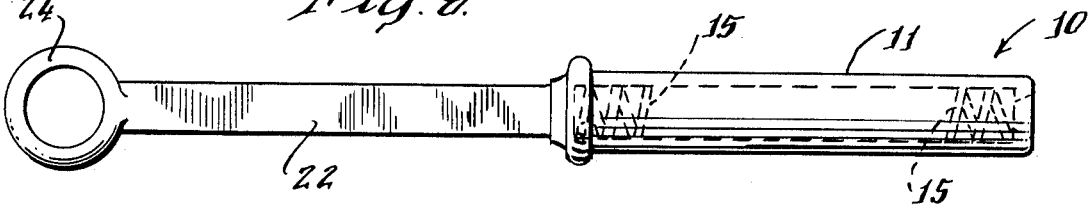
Fig. 8a.
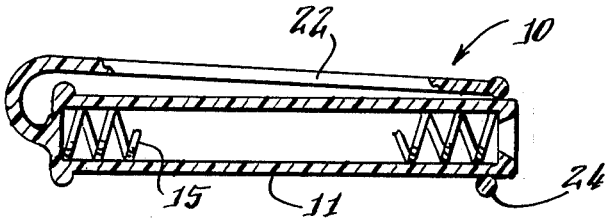
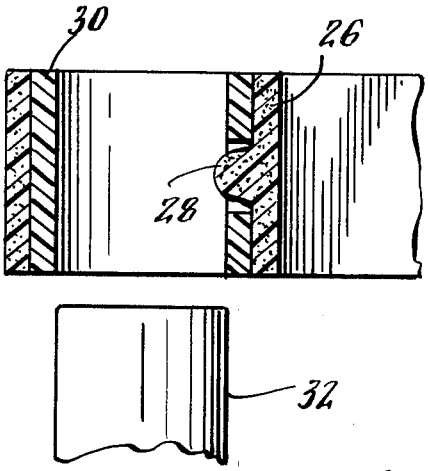
Fig. 9.
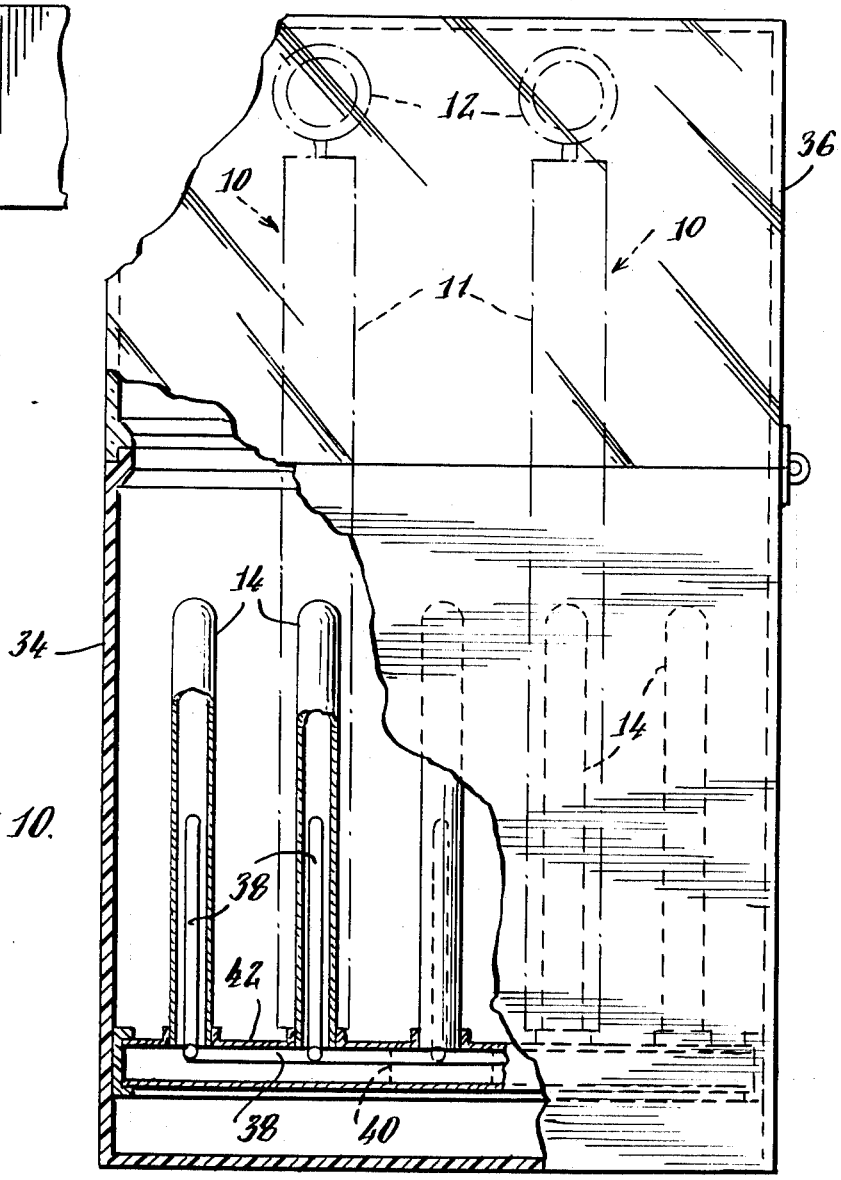
Fig. 10.

SOFT ROLLER HAIR CURLER AND HEATING ARRANGEMENT THEREFOR

The present invention relates to a soft roller device for curling hair, and a carrying case for rollers provided with heated posts for each of the rollers placed in the carrying case. The rollers consist of an elongated molded silicone rubber sleeve within which a coil spring is mounted. The rollers can be manipulated by hand to various selected configurations and secured in the hair while a desired curl is being set. The roller further assumes its original linear shape when removed from the hair.

Soft roller curlers are known which are simply a long wire covered with spongy rubber. The user rolls her hair into a curl on the roller and twists the ends of the roller together to maintain the roller in a curved immobile condition. The roller is removed after a period of time when a curl has been made.

The present invention insures that pronounced curls, which are longer lasting, are created by the use of heated posts to heat a coiled spring within the soft, heat conducting roller constituting a molded silicone rubber sleeve. The heating arrangement is provided with a thermostat which controls the temperature of the spring within the roller to maintain a relatively constant value of approximately 140° C. However, the exterior surface of the roller, because of the use of silicone rubber, is maintained at a temperature which is comfortable to the touch, since it has a quality of heat resistance to a certain degree, yet also transmits heat to its exterior surface.

The silicone rubber sleeve with the coil spring therein forms a soft roller which can be twisted by finger manipulation into various configurations and is held in a selected position by means of an end loop or cap which can be inserted over the opposite end of the elongated roller sleeve to hold the curled hairs in position.

It is a further object of the present invention to provide heated posts over which the internal coiled spring of the roller is inserted and to which the spring is heated to a useful temperature for the purposes required, and an even heat distribution is created throughout the coils of the entire spring.

It is yet another object of the present invention to provide a carrying and/or storage case for a plurality of soft roller hair curlers which may be placed on selected heated posts within recesses in a carrying case so that said rollers can be selectively stored and heated therein.

It is another object of the present invention to provide a soft roller hair curler having an elongated strap attached at one end, and provided with a loop at the free end of the strap whereby strands of the user's hair can be wound around the roller, while the latter is in a linear or straight position, and the end loop fastened over the opposite end of the roller with the strands of hair therebetween.

A feature of another embodiment of the roller of the present invention is the use of a rigid inner sleeve having an opening therein whereby a part of the silicone rubber outer sleeve projects therethrough so that a securing member on one end of the roller can be inserted through the inner sleeve on the other end of the roller and held in place by the projecting part of said silicone rubber sleeve.

In order that the invention will be more clearly understood, it will now be disclosed in greater detail with reference to the accompanying drawings, in which:

FIG. 1 is a perspective view of the soft roller hair curler constructed in accordance with the teachings of my invention.

FIG. 2 is an enlarged cross sectional view of the soft roller hair curler.

FIG. 3 is a side elevational view of the soft roller hair curler in its folded position with the end loop inserted over the other roller end.

FIG. 4 is an elevational view of an alternate embodiment of the invention showing the roller sleeve having a short strap connection between the end cap and the adjacent end of the roller.

FIG. 5 shows the end cap and strap arrangement of FIG. 4 in its folded condition.

FIG. 6 shows the soft roller hair curler constituting my invention in use on a person's head.

FIG. 7 is a partial sectional and partial elevational view of another embodiment of the invention showing another type of coiled spring within the sleeve member.

FIG. 8*a* is a part elevational and a part sectional view of another embodiment of the invention having an end loop securing member on an elongated strap connected at one end to a soft roller hair curler, while FIG. 8 is a top plan view thereof.

FIG. 9 is a sectional view of a further embodiment having a rigid sleeve which is inserted in a silicone rubber sleeve or cover member, and FIG. 10 is a front elevational view of a carrying case for the soft roller hair curlers constructed in accordance with the teaching of the present invention.

Referring to FIGS. 1–3, a soft roller 10 is adapted to be heated internally by means of a heated post 14, as seen in FIG. 9. Thus, the elongated soft roller 10 is provided with a coil spring 15, as seen in FIG. 2, and an end loop 14 of silicone rubber. The outer cover 11 is fabricated of a molded silicone rubber and is provided with a short connecting piece 16. It should be evident that in order to concentrate the heat in any portion of the coil springs, the turns thereof can be made close together, thus forming in effect a heat sink. It will be noted that the soft roller said curler is extremely flexible, and can be bent and twisted and held in a substantially curvilinear condition by means of fastening the end loop 12 to the other end of the roller 10, as seen in FIG. 3. The appearance of the rollers in the hair is shown in FIG. 6, it being noted that upon release the end loop or cap from the end of the roller, the latter assumes its original elongated linear position, as shown in FIGS. 1 and 2.

As seen in FIGS. 4 and 5, another version of the soft roller hair curler should be noted. The only difference between that roller and the roller shown in FIG. 3 is the use of a short strap portion 18 and an end cap 20. The spring 15 may also take the form of an interrupted coiled spring having linear portions 15*a* connecting coil sections 15, as seen in FIG. 7. The linear portions are constituted of stiff bendable wire, which will not return the soft roller to its original condition upon release, but will remain in the bent form until manually bent back to its linear condition. This arrangement permits the curler to assume other configurations, like the letter S, and remain in that condition while curling the hair thereon until it is no longer necessary to maintain that configuration.

FIGS. 8 and 8*a* disclose a soft roller hair curler having an elongated strap 22 provided with an end loop 24. This arrangement permits strands of hair to be wound around the roller 10, while the latter is in a straight or linear position, and the strap 22 pulled over the hair and the end loop fastened on the opposite end of the roller so that the strands of hair are captured between the roller and the strap. FIG. 9 discloses another embodiment of the invention in which the silicone rubber sleeve 26 is provided with an inwardly directed part 28. The silicone rubber sleeve forms a cover and has an internal sleeve 30 of rigid material, such as a polypropylene resin. Thus, the internal surface of the sleeve 30 is smooth and permits the ready insertion and withdrawal of the projection 32, on the opposite end of the roller. However, since the silicone rubber part 28 is engaged by the projection 32 upon insertion of the latter in the other end of the roller, the projection 32 is held in a latched condition whereby the roller assumes a bent condition.

Referring now to FIG. 10, it should be observed that the soft rollers 10 are stored in a carrying case 34 having a top cover 36. A plurality of heated posts 14 are shown, which are heated by a heater 40 in the form of a heating wire element 38, which is connected to a thermostat. For example, the heater 40 may take the form of a rope-type heating element located on the underside of an aluminum plate 42. Thus, the heaters 40, in the form of rope-type heating elements, are positioned within each of the heating posts, and the latter transmits heat to the rollers positioned thereon. The thermostat is calibrated to maintain a desired temperature for each of the rollers. It should also be pointed out that since soft rollers are made of silicone rubber, it is possible to use higher temperatures than conventional units without creating discomfort to the user, and at the same time achieving a better curl. It has been found that the thermostat calibration of 150° C. results in a temperature of the spring 15 which is about a 140° C. The selected temperature results in the outside surface of the roller being comfortable to the touch, and at the same time achieving a superior curl.

The carrying case and storing means for the soft rollers is both compact and portable, and permits the rollers to be heated to the desired temperature in place, prior to use.

It is possible to use two or more rollers in juxtaposition whereby a tight curl is wound around one of the rollers and a large curl around both of the rollers that are alongside each other. Thus, the rollers can be positioned in juxtaposed relationship with one end of each of the rollers being secured to the other end thereof whereby one roller is pulled over a tight curl while the other roller is pulled over the large curl, thus holding the curls in place.

The present rollers have the ability to be formed to a configuration which suits an individual's requirement, and the hair is secured in the rollers while the desired curl is being set. Upon removal of the rollers, each of the rollers assumes its original linear shape.

While the invention has been disclosed and described herein with reference to a certain number of embodiments, it is apparent that variations and modifications may be made which will fall within the true spirit and scope of the invention as defined in the following claims.

What is claimed is:

1. An elongated roller hair curler for wrapping hair about the exterior surface thereof comprising an outer sleeve of soft yieldable material, a heatable flexible spring element within said sleeve and adapted to be heated by induction, and means on one end of said sleeve for removably attaching said end to the other end of said roller when said roller is bent to a position whereby the other end is located adjacent to said securing means.

2. A soft roller hair curler as claimed in claim 1 wherein said sleeve is constituted of silicone rubber.

3. A soft roller hair curler as claimed in claim 1 wherein said coiled spring is provided with at least one area wherein the coils are closely packed relative to other coils of said spring.

4. A soft roller hair curler as claimed in claim 1 wherein said coiled spring is continuous but connected by at least one part that is linear, and that is yieldable to a selected fixed position.

5. An elongated roller hair curler comprising a sleeve of molded silicone rubber, a metallic coil spring therein having an elongated opening along the longitudinal axis of said sleeve, means for insertion in said opening and heating said spring whereby heat is transferred from said spring to said sleeve, and means on one end of said sleeve for removably attaching to said other end of said roller when said roller is bent to a position whereby the other end is located adjacent to said securing means.

6. A soft roller curler as claimed in claim 1 wherein said securing means at one end thereof is an elongated flexible strap provided with a loop at its free end, said strap being adapted to be pulled over said roller in its linear condition after hair has been wound around said roller, and said loop is thereafter placed over the other end of said roller to thereby capture said hair between said roller and said strap.

7. An elongated roller hair curler comprising an outer sleeve of silicone rubber, an inner sleeve forming a rigid insert at one end of said roller, said inner sleeve having an aperture therein whereby a part of said silicone rubber protrudes therethrough, a heatable flexible element within said sleeve, and a projecting insert at the other end of said roller for insertion in said one end whereby said insert is held within said inner sleeve by means of said silicone rubber part that protrudes through said aperture.

* * * * *

UNITED STATES PATENT AND TRADEMARK OFFICE

CERTIFICATE OF CORRECTION

PATENT NO. : 4,572,221

DATED : February 25, 1986

INVENTOR(S) : GEORGE BARRADAS

It is certified that error appears in the above-identified patent and that said Letters Patent is hereby corrected as shown below:

Claim 3, line 2, cancel "coiled" and after "spring" insert --is a coiled spring and--.

Claim 4, line 1, change "1" to --3--.

Signed and Sealed this

*Nineteenth* Day of *August 1986*

[SEAL]

*Attest:*

DONALD J. QUIGG

*Attesting Officer*

*Commissioner of Patents and Trademarks*